United States Patent [19]

Chow

[11] 4,015,554

[45] Apr. 5, 1977

[54] CONSTRUCTION AND LAUNCH BARGE AND METHOD OF PRODUCING AND INSTALLING OFFSHORE STRUCTURES

[75] Inventor: Philip Y. Chow, Orinda, Calif.

[73] Assignee: Lin Offshore Engineering, Inc., San Francisco, Calif.

[22] Filed: May 2, 1975

[21] Appl. No.: 574,110

[52] U.S. Cl. ..... 114/65 R; 114/283; 114/31; 114/267; 114/125

[51] Int. Cl.[2] ..... B63B 9/00

[58] Field of Search ..... 114/77, .5 R, .5 F, 114/44, 45, 26, 27, 65, 121, 125, 43.5 R, 43.5 VC, 31, .5 T

[56] References Cited

UNITED STATES PATENTS

| | | | |
|---|---|---|---|
| 3,541,588 | 11/1970 | Ragland | 114/.5 T |
| 3,610,192 | 1/1969 | Mauritzen | 114/45 |
| 3,736,898 | 6/1973 | Yamura | 114/45 |
| 3,756,179 | 9/1973 | Laffont | 114/.5 F X |

*Primary Examiner*—Trygve M. Blix
*Assistant Examiner*—Sherman D. Basinger
*Attorney, Agent, or Firm*—Owen, Wickersham & Erickson

[57] ABSTRACT

A construction and launch barge having a shallow draft hull with a construction deck supporting at its center a floatable offshore structure both during construction thereof and during the towing of the barge to the site where the offshore structure is to be installed. In order to maintain stability, a plurality of hollow column stabilizers are provided on the barge; these may be, e.g., four, one adjacent to each corner of the barge and extending up high thereabove. A ballast compartment helps determine the desired waterline of the vessel, a mechanism being provided to displace the water therein by air or to displace the air by water. The column stabilizers are sufficiently high and occupy sufficient area for assuring the proper location of the metacenter of the fully loaded barge. The structure enables the construction of large offshore structures of concrete in relatively shallow water and enables towing the offshore structure across relatively shallow water to a desired location and then separating the barge from the offshore structure by sinking the barge to a sufficient depth, releasing the then-floatable offshore structure from the barge, and then displacing the barge away from the offshore structure. Then the barge is raised again and returned to shore. The offshore structure may then be lowered into its operating location.

6 Claims, 15 Drawing Figures

FIG. 9
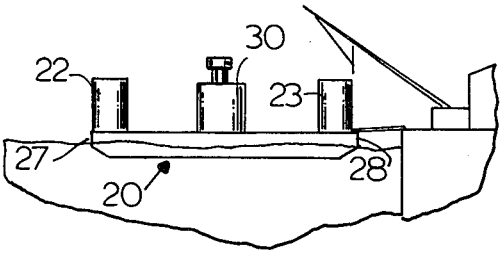
FIG. 10
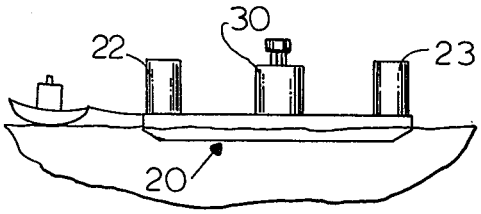
FIG. 11
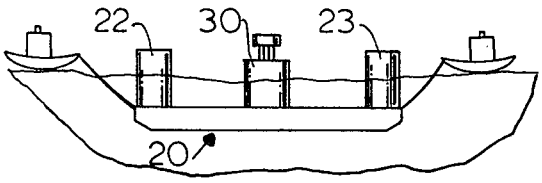
FIG. 12
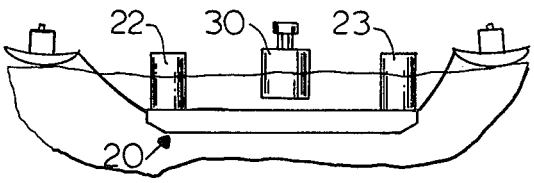
FIG. 14
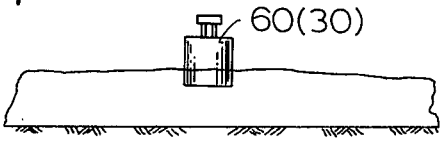
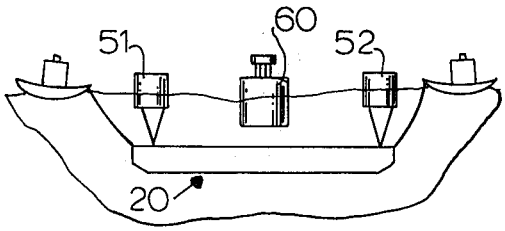
FIG. 13
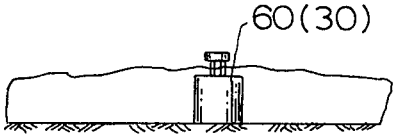
FIG. 15

CONSTRUCTION AND LAUNCH BARGE AND METHOD OF PRODUCING AND INSTALLING OFFSHORE STRUCTURES

BACKGROUND OF THE INVENTION

This invention relates to a construction and launch barge for the construction and launching of offshore structures made of concrete. It also relates to a method of constructing and installing offshore structures.

Until recently, offshore structures have been steel, have been constructed on shore, have been launched in water, and have been towed to their site of operation in a horizontal floating position by a shallow draft vessel.

However, recently, in the North Sea gravity concrete offshore structures have been introduced, and these have ushered in a completely different construction technique. These gravity concrete structures are much heavier than steel structures and have required sheltered construction sites where the water is more than two hundred feet deep. This depth is needed both during construction and also during the full length of the route along which the completed structure is towed to its site of operation. The contemporary method of constructing such concrete offshore structures includes building a lower watertight portion of the structure in a dry dock. The dry dock is located adjacent to the sea and has a construction floor that is below sea level. The floor level is determined by the draft necessary to float and move the partially completed structure to a deep water wet dock, where the upper portion is added and the structure completed. The requirement that there be a wet dock imposes a difficult condition for the production of gravity concrete structures, even where such wet docks are available or can be made. Such construction facilities are found in very few places, mostly in the fjord region of Norway. Therefore, in other parts of the world, including the United States, where such facilities are lacking, the construction must be carried out without a deep water dry dock or a wet dock, and this has limited the use of concrete structures.

An object of the present invention is to make it possible to construct major concrete offshore structures without using a deep water dock. The structure, or a large portion of it, may be constructed directly on a barge embodying this invention and then later transported to the operating site and launched, without the offshore structure having to leave this construction vessel until the moment it is actually launched. The barge serves as a shallow draft construction dock, as a barge for transporting the object to be constructed to the operating site, and also as a mechanism for launching the offshore structure by submerging the barge and then moving it out from beneath the offshore structure.

Another object of the invention is to make it possible for offshore structures of concrete to be constructed in water depths of no more than forty or fifty feet, while the prior-art wet-dock type of construction would require a water depth of 200 feet or more for the same structure. Similarly, the present invention enables transport or towing of such structures through water that is only 40 or 50 feet deep, whereas the prior art required a depth of two hundred fifty or more for the same structure.

Another object of the invention is to enable more rapid transportation of the offshore structure. When the offshore structure is towed in a deep-draft floating position, the towing is very slow, and exposure and risk are heightened because of the greater length of time during which storms may arise. In the present invention it becomes possible to shorten the time for transporting and launching the offshore structure at its site and to lessen the risks and exposures on the open sea.

SUMMARY OF THE INVENTION

The invention basically comprises a large barge, which may be made of steel or of prestressed concrete. It may be made either in a single piece, monolithically, or may be made in several modules which are joined together to make up any size required for constructing a particular structure intended for offshore installation. The barge has ballast compartments below deck level, the offshore structure being constructed on the deck level, and the ballast compartment is equipped with control for both ballasting and blowing the tanks.

A very important feature of the invention is the provision, preferably at four corners of the barge, of column stabilizers. These column stabilizers and their location close to the corners of the barge provide the heavily loaded barge with the needed stability when the barge is completely submerged. They help to control the descent of the barge. The column stabilizers must be of sufficient area and height and must be so located that the metacenter of the barge, plus its load and its ballast, is maintained above the center of gravity at all times, thereby insuring the needed stability, during towing, construction, and launching.

In one form of the invention the columns are permanently fixed to the deck. In this form, the column stabilizers extend up higher than the draft of the offshore structure when that structure floats.

In another form of the invention the columns are detachable and themselves float when detached. In this particular structure the barge proper is connected to the columns by a winched system of cables, and, when the barge is to launch the offshore structure, the barge is ballasted sufficiently for it to sink away, first from the column stabilizer and then from the offshore structure, the descent of the barge being accomplished and controlled with the aid of winches that may be housed in the floating column stabilizers. The barge lowering operation is coordinated among the column stabilizers to make sure that the barge is lowered and raised evenly and is kept in a horizontal position. Then when sufficient clearance is obtained between the bottom of the offshore structure, which is then floating, and the deck of the barge, which is then submerged, the floating column stabilizers are pulled sideways by tugs to move the submerged barge out from under the floating offshore structure. At a safe distance from the offshore structure, the barge is winched up, reattached to the bottoms of its column stabilizers, and deballasted. First stage ballast tanks may be blown by compressed air and bottles attached to the column stabilizers, to bring the barge to the surface, and then second stage tank blowing may follow, to raise the barge to its proper towing position, either while the barge is being towed back to shore for reuse or, preferably, just before towing begins.

Other objects and advantages of the invention and a more complete understanding of both its principles and the ways in which it can be employed will appear from the following description of some preferred embodiments.

BRIEF DESCRIPTION OF THE DRAWINGS

In the drawings:

FIGS. 9 through 15 are diagrammatic illustrations in side elevation of the towing and launching of the barges.

FIG. 9 is a view of the construction and launching barge of FIGS. 1–3 shown at the port with the offshore structure just completed.

FIG. 10 is a view of the barge of FIG. 9 being towed to its installation position.

FIG. 11 is a similar view of the lowering of the barge to about where the offshore structure is in its floating position.

FIG. 12 is a similar view of the barge lowered down below the offshore structure, so that the offshore structure floats freely. The next step will be to move the barge out from under the offshore object, by translation, and then it will be refloated.

FIG. 13 is a view similar to FIG. 12 but with the barge structure of FIGS. 7 and 8.

FIG. 14 is a similar view of the offshore structure fully launched and floating, with the barge withdrawn.

FIG. 15 is a view of an offshore structure sunk to a final position.

DESCRIPTION OF SOME PREFERRED EMBODIMENTS

THE BARGE 20 OF FIGS. 1–6 AND 9–12

Figure 1:
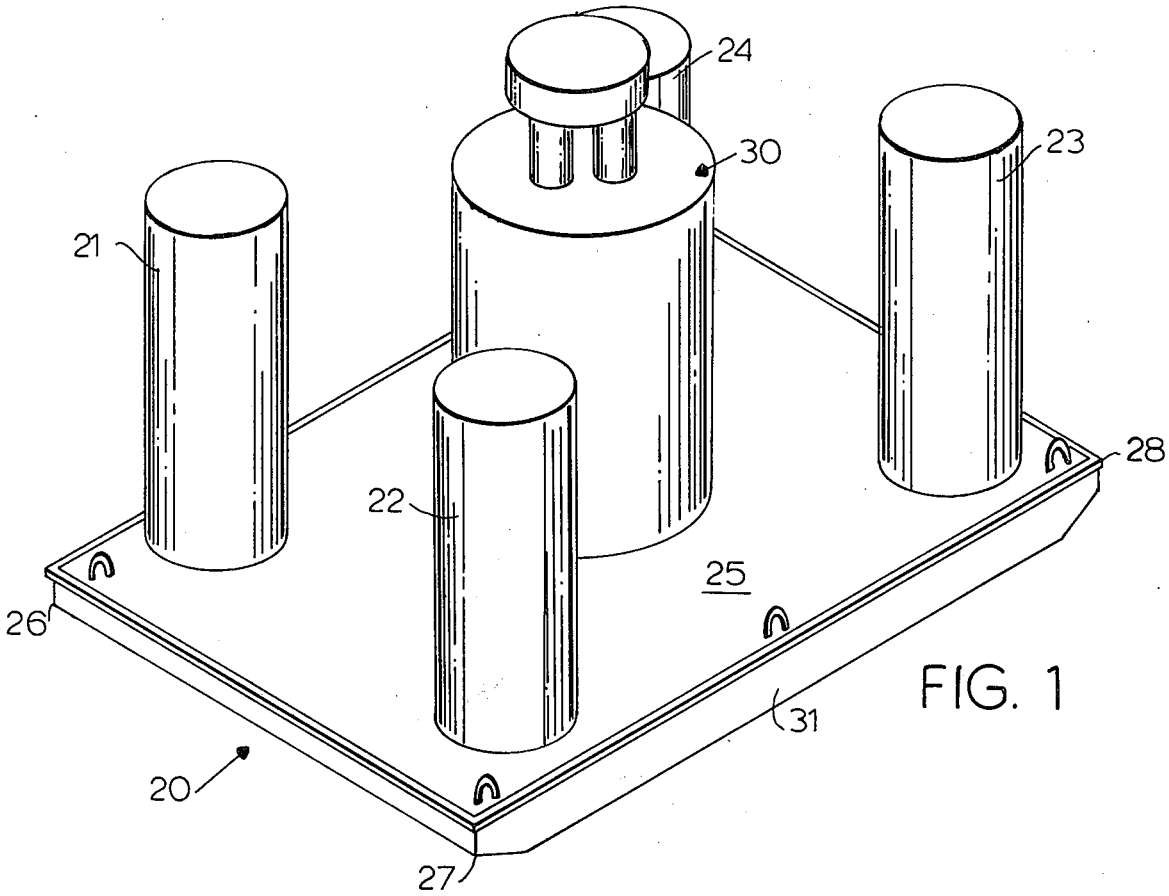
FIG. 1 is a view in perspective, somewhat diagrammatic in nature, of a construction and launching barge embodying the principles of the invention. In this form of the invention the column stabilizers are permanently attached to the barge, and an offshore structure that has been built on the barge is shown in the center. The barge is "monolithic".

In one form of the invention, a construction and launch barge 20 is provided having four identical column stabilizers 21, 22, 23, and 24, all permanently secured in a fixed position to the barge 20 and projecting up a considerable distance above a deck 25. Each one of the identical column stabilizers 21, 22, 23, and 24 is hollow and is in itself quite buoyant, and the four are located, symmetrically, as near as practical to the barge's corners 26, 27, 28, and 29, in order to take maximum advantage of their size, shape, and positions relative to each other and to the barge, to achieve stability of the loaded barge 20. An offshore structure 30 rests on the deck; it may be, but not necessarily, a concrete structure of any desired type. This structure 30 is assembled either completely or partially, in its final stages, right on the deck 25; it is well centered relative to the barge 20 and is held in place by any suitable anchorage means to prevent its shifting during the towing. The structure 30 may be built from the beginning by pouring concrete into molds resting on the deck 25, or a bottom portion may be made elsewhere and brought to the deck 25, and then the upper portions constructed thereon on the deck 25.

Figure 2:
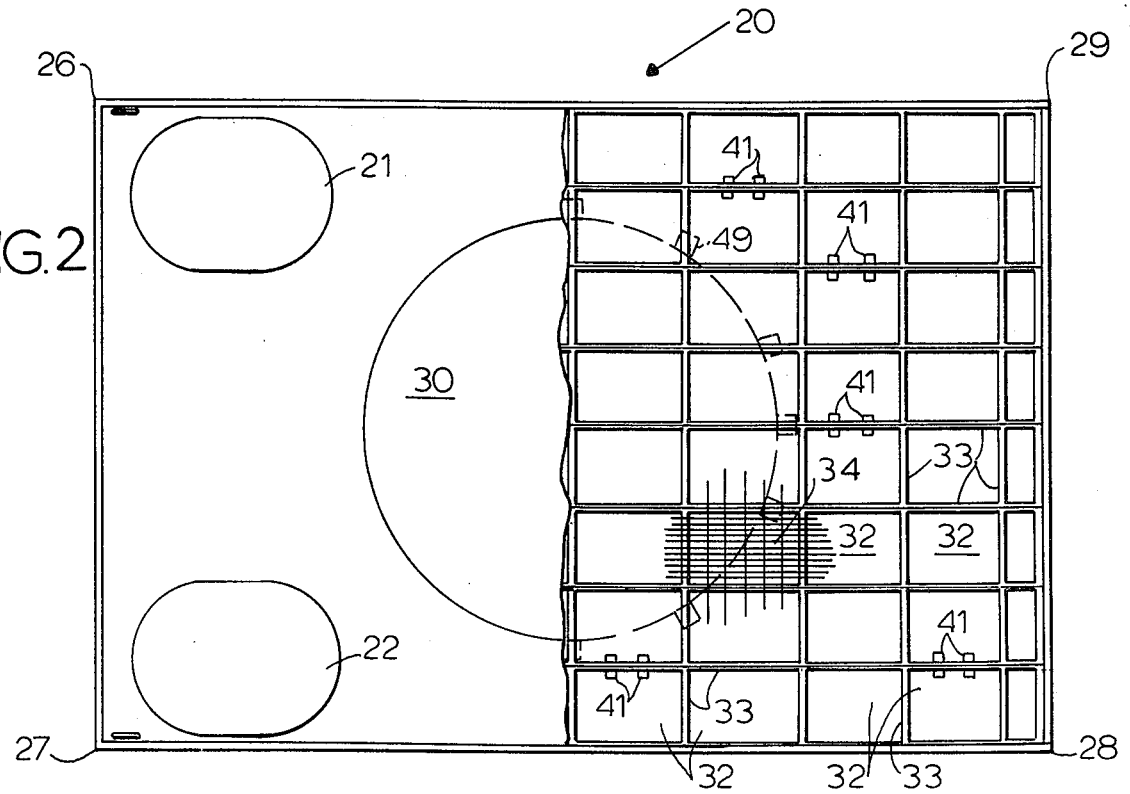
FIG. 2 is a plan view of a barge similar to that of FIG. 1 with the left half looking from above the tops of the column stabilizers and the top of the offshore structure, while the right hand side is partly in a horizontal section taken below the deck, in order to show the structure and the ballast tanks thereof. In this barge, the hull is built of a series of components each the full length of the barge, joined together across the width.
Figure 3:
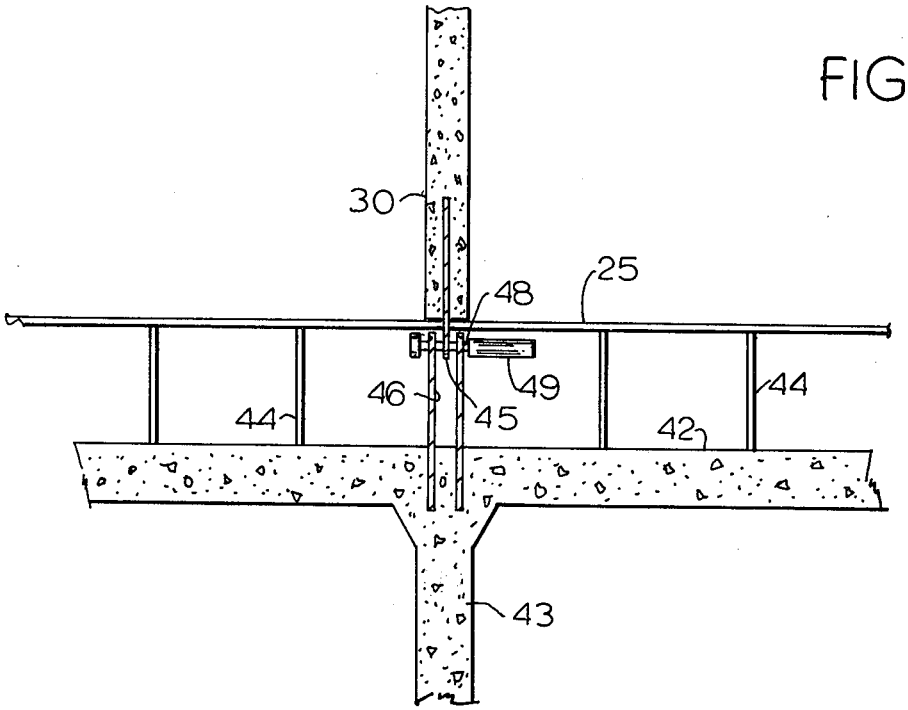
FIG. 3 is a fragmentary view in elevation and in section of a portion of the barge and deck.

The barge 20 has a hull 31 that is provided with a series of buoyancy tanks 32 (See FIGS. 2 and 5) divided by walls 33. The hull 31 is made to provide a sufficiently strong and durable structure to withstand both the construction and the towing operation. It may be made from steel or may be made from reinforced and prestressed concrete. The drawing, FIG. 2, shows some stringers or joists 34. The buoyancy tanks 32 enable flotation and submergence of the types desired. Some of these buoyancy tanks 32 may be located directly below each of the four column stabilizers 21, 22, 23, and 24, and compressed air tanks 35 for them may be provided within the column stabilizers, as indicated in FIG. 3. A control center 36 and accommodations 37 for a crew may be provided in one or more of the column stabilizers, preferably near the upper end thereof. The control center 36 includes control mechanism 38 for all of the buoyancy tanks 32, and it may include mechanism for assuring simultaneous ballasting and deballasting of symmetrically located ballast tanks 32. Compressed air tanks other than those in the columns 21, 22, 23, and 24 may be located on the barge 20 at any desired locations. The buoyancy tanks 32 are sufficient in number and size and total volume to enable the barge to be adequately sunk during launching and also to float properly when the full load is placed thereon.

Figure 6:
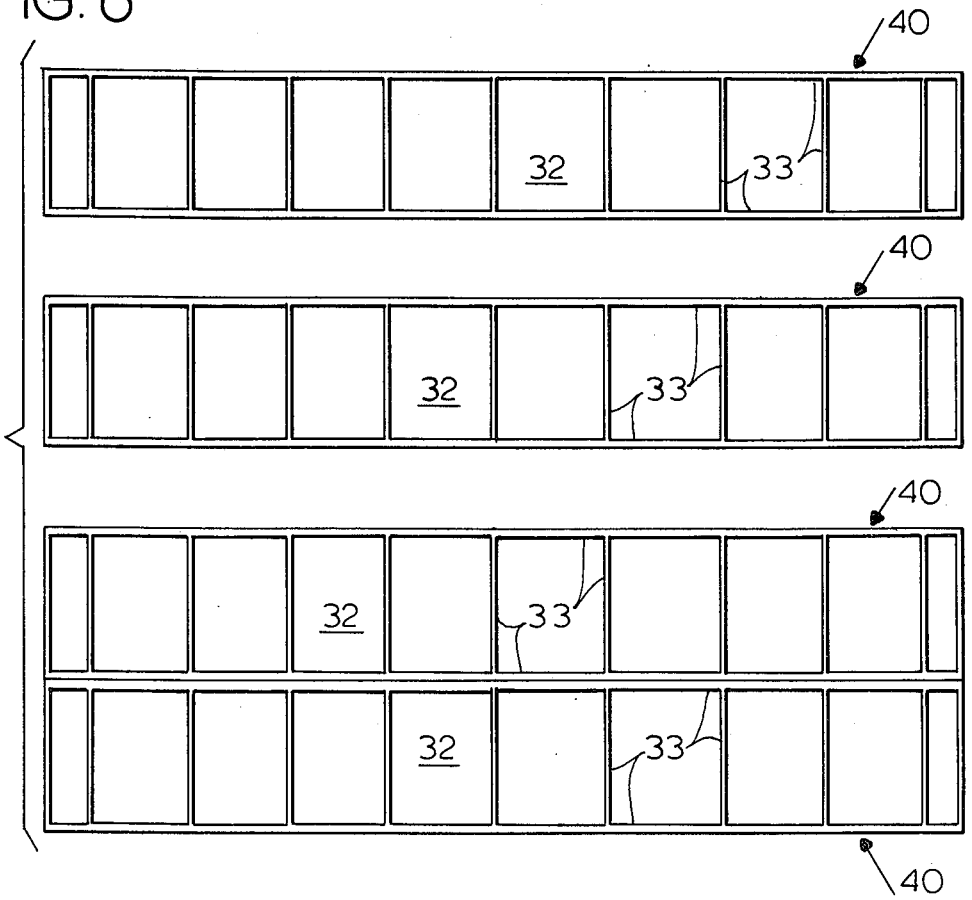
FIG. 6 is an exploded view of a portion of the barge of FIG. 2, showing two components joined and two others not yet joined to them.

As shown in FIGS. 2 and 6, the barge 20 may be made of a series of components 40, each of which extends for the full length of the barge and for only a fraction of its width. The components 40 are made separately to provide any desired size and are then joined together, as by bolt assemblies 41.

Figure 4:
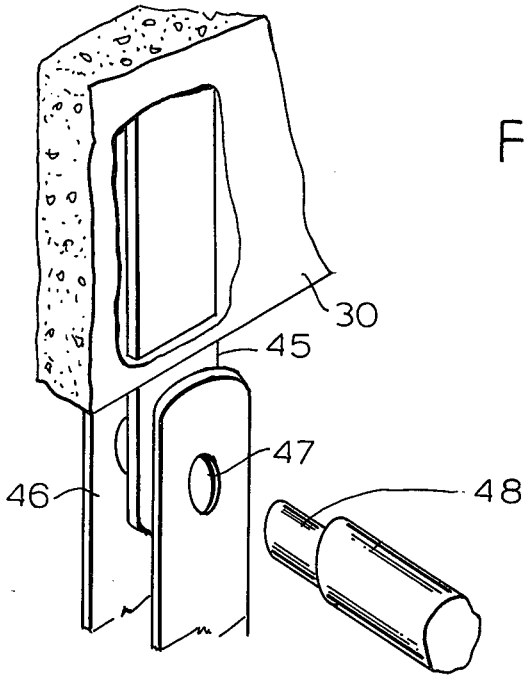
FIG. 4 is a fragmentary view in perspective of the releasable connection means securing the offshore structure to the barge.

FIGS. 2, 3, and 4 show how the offshore structure 30 may be releasably secured to the barge 20. The construction deck 25 may be a raised base from above and be spaced from a deck 12, which rests on structural frames 43 of the barge. The raised base form 25 is supported by verticals 44 about the height of a man above the deck 42. Connection members 45 secured to the bottom of the offshore structure 30 extend down below it and fit in between two bars 46 that are secured to the barge frame, as to the members 43. The members 45 and the bars 46 have aligned perforations 47 through which a pin 48 on a hydraulic ram 49 extend to hold the offshore structure 30 to the barge 20. The rams 49 are actuated hydraulically at such time as is desired to release the structure 30 from the barge 20.

This is done when the barge 20 is sunk to about the level where the structure 30 can float and enables separation of the barge 20 from the offshore structure.

Figure 5:
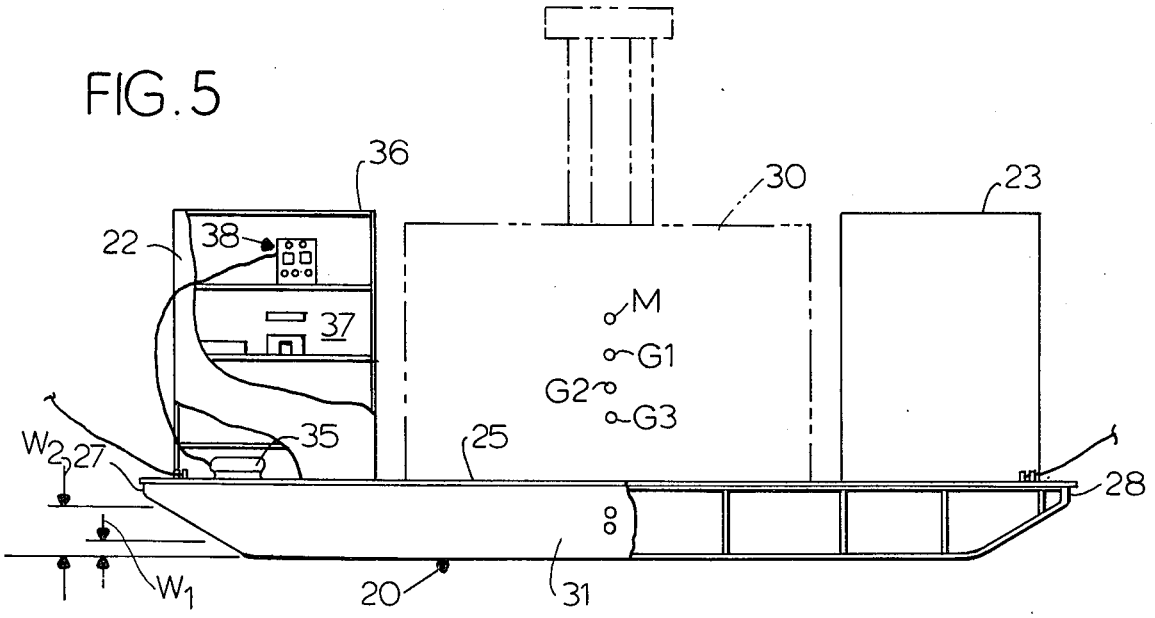
FIG. 5 is a view in side elevation of the barge of either FIGS. 1 and 2 with some portions broken away and shown in section. Also, various waterlines are indicated, including that of the offshore structure itself, and various centers of gravity, metacenters, and centers of buoyancy are shown.

The column stabilizers 21, 22, 23, and 24 are effective in maintaining the stability of the barge 20 because this maintains a positive metacenter distance above the center of gravity at all times. FIG. 5 shows the metacenter M and three centers of gravity: $G_1$ the center of gravity of the offshore structure 30, $G_2$ the center of gravity of the combined weight of the offshore structure 30 and the barge 20, and $G_3$ the center of gravity of the barge 20, the offshore structure 30, and the ballast water in the barge. The invention requires that the metacenter M be higher than all three centers of gravity $G_1$, $G_2$, and $G_3$. It is very important that the metacenter M (See FIG. 5) be kept above the center of gravity $G_2$ of the combined weight of the offshore structure and the barge, at the critical stage when the barge 20 proper is lowered to just below the surface of the water.

As FIG. 5 shows, the draft water level $W_1$ is that of the lightly loaded barge 20, as before construction begins. When the barge 20 is under full load, the draft is increased to a water level $W_2$ below the deck 25 of the barge 20. At that time, the height of the metacenter M has to be greater than the height of the combined center of gravity $G_2$ of the barge 20 and the full load; by the classic equation, the metacenter equals $I_1V$, where $I_1$ is the moment of inertia at the water level $W_2$ and V is the volume of the displaced water.

When the water level is at the top of the barge, the height of the metacenter M must, of course, still be above the pertinent center of gravity, which in this instance is $G_3$, being the center of the gravity of the offshore object plus that of the barge plus that of the ballast water necessary to raise the water plane to that height. This means that the pertinent equation for the height BM of the metacenter M above the center of buoyancy B is $$BM = \frac{I_2}{v},$$

in which $I_2$ is the total moment of inertia of the water plane intersecting the column stabilizers and the offshore object.

$$I_2 = I_c + I_{clo}.$$

where $I_c$ is the total moment of inertia across the column stabilizers and $I_{clo}$ is the moment of inertia across the offshore object.

Furthermore, $I_c = 4A_c \times B_c^2$, where $A_c$ is the area of each of the column stabilizers and $B_c$ is the transverse distance from the center of the vessel to the center of the column stabilizer. As a result of these relationships, the minimum $A_c$ of each column stabilizer can be determined and the construction made accordingly.

THE BARGE OF FIGS. 7, 8, AND 13

Figure 8:
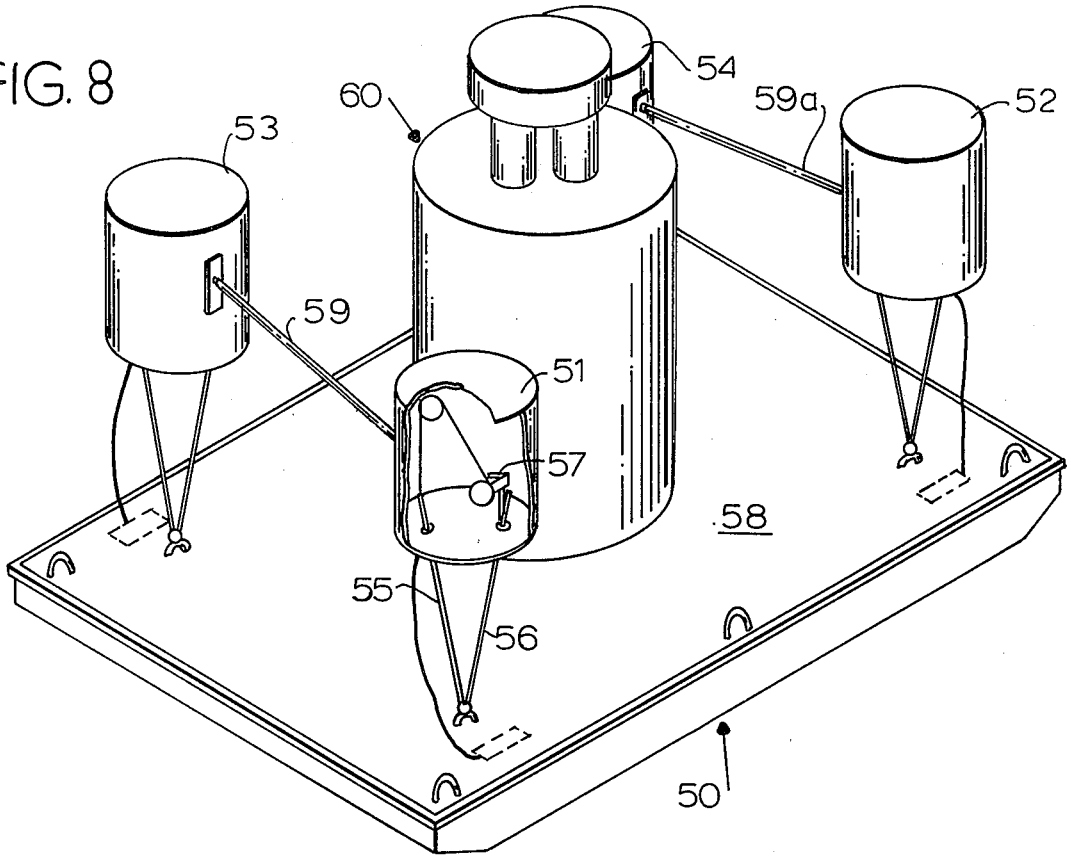
FIG. 8 is a view in perspective of the barge of FIG. 7 shown in the position it assumes when the barge is being separated from the offshore structure by submersion of the barge.
Figure 7:
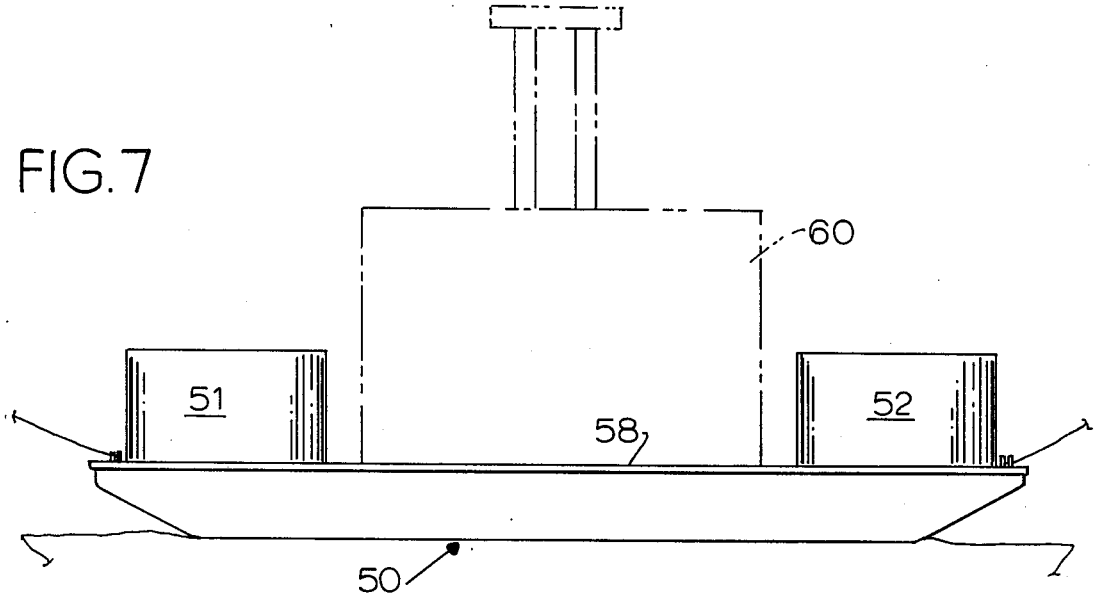
FIG. 7 is a view similar to FIG. 5 of a modified form of the invention in which the column stabilizers are detachable from the barge.

FIGS. 7 and 8 show a barge 50 generally like the barge 20 but with the important difference of having detachable column stabilizers. Thus, a barge 50 of this structure, which is in so many other particulars like that of the barge 20, differs in that each of its four column stabilizers 51, 52, 53, and 54, and two located behind them in FIGS. 7 and 8, is detachable, being connected to the barge 50 by cables 55 and 56, which are operated by winches 57. The column stabilizers 51, 52, 53, and 54 may thus be down at approximately the level of the deck 58 during normal operation, when the deck 58 is above the waterline of the vessel 50. Then, when the offshore structure 60 is to be launched, the barge 50 proper is ballasted to submerge, as before, until the water level rises to a predetermined level, such as approximately halfway up the column stabilizers 51, 52, 53, and 54. Then the winches 57 are used to disconnect the barge 50 from the column stabilizers 51, 52, 53, and 54, except for the connection through the cables 55 and 56. Further descent of the barge 50 proper is by winding out the cables 55 and 56. The transverse distances between the floating column stabilizers 51 and 53 and between the floating column stabilizers 52 and 54 are controlled by two floating struts 59 and **59*a***. The relative positions of the columns is maintained by work boats or tugs.

Controls for the ballasting and deballasting may be provided in one of these column stabilizers 51, 52, 53, and 54 and a control is also provided for operating all the winches 57 at the same time to keep the barge 50 horizontal. For this purpose, then, the column stabilizers 51, 52, 53, and 54 are kept so that they are at all times partially above the water level. During much of the time they may be partly below water level, as shown in FIG. 8 and FIG. 13, but their upper ends are always kept above water level. These column stabilizers 51, 52, etc., have sufficient buoyancy to support themselves and also the submerged barge 50 proper and need not be as tall as the tanks 21, 22, 23, and 24 shown before, since it is the column areas and the relative positions of these areas at water level that are of particular significance in maintaining stability during the descent and ascent of the barge 50 proper.

It is necessary to keep the maximum draft $D_c$ of each column stabilizer 51, 52, 53, 54, to the proper level at all times during the descent of the barge 50 and the offshore object 60. This is governed by the relation:

$$B_{sink} < \text{water density} \times D_c \times (4A_c + A_{clo}),$$

where $B_{sink}$ is the portion of barge buoyancy that has to be neutralized by ballast water before the barge 50 can be lowered away from the column stabilizers 51, 52, 53, and 54 by winding, $D_c$ is the maximum draft of the detachable type of column stabilizer 51, etc., $A_c$ is the area of each column stabilizer 51, etc., and $A_{clo}$ is the water-displacing area of the offshore structure 60.

With these things kept in mind, the operation is similar to that described before, except at the stage of launching of the offshore structure 60. When the barge 50 is ballasted sufficiently for it to sink away from the offshore structure 60, the offshore structure 60 is released, and the offshore structure 60 floats, then the column stabilizers 51, 52, 53, and 54 may be pulled sideways by tugs 61, 62 to move the barge 50 away from under the offshore structure 60. Once the barge 50 is at a safe distance therefrom, it is winched up and reattached to the bottom of the column stabilizers 51, 52, 53, and 54. Then the first-stage ballast tanks are blown by compressed air and by bottles attached to the barge to raise the barge 50 to the surface. The controls for this may be in one of the column stabilizers. Then second-stage tank blowing may follow as the barge is being towed back to shore for reuse.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A construction and launch barge, including in combination:

a barge hull of shallow draft, a construction deck supported by said hull for support of a floatable offshore structure at the center thereof during construction and during towing of said barge to an offshore site, four hollow buoyant column stabilizers, one located adjacent to each corner of said barge, detachably secured thereto and attached thereto by cable means, and connected together in pairs by struts, ballast compartments below deck, means for admitting water to and for expelling it from said ballast compartments, and means for forcing air into and for expelling it from said ballast compartments, said column stabilizers being of sufficient size and water displacing area so that the resultant metacenter of the barge under full load, including the floatable offshore structure carried thereby, is always above the center of gravity under full load and also always above the center of gravity of the combined barge under full load and the ballast water needed to raise the water plane to the water plane of the floatable offshore structure.

2. A construction and launch barge, including in combination:

a barge hull of shallow draft, said hull consisting essentially of a series of components, each extending the full length thereof but only a portion of the width thereof, a construction deck supported by said hull for support of a floatable offshore structure at the center thereof during construction and during towing of said barge to an offshore site, a plurality of watertight, hollow buoyant column stabilizers, located adjacent to each corner of said barge and extending upwardly from said deck, said column stabilizers for their full width and full height enclosing air and no other fluid, ballast compartments below deck, means for admitting water to and for expelling it from said ballast compartments, and means for forcing air into and for expelling it from said ballast compartments, said column stabilizers being of sufficient size and water displacing area so that the resultant metacenter of the barge under full load, including the floatable offshore structure carried thereby, is always above the center of gravity under full load and also always above the center of gravity of the combined barge under full load and the ballast water needed to raise the water plane to the water plane of the floatable offshore structure.

3. A construction and launch barge, including in combination:

a barge hull of shallow draft, a construction deck supported by said hull for support of a floatable offshore structure at the center thereof during construction and during towing of said barge to an offshore site, locking means directly secured to a below-deck horizontal portion of said hull for securing the lower end of a said offshore structure directly to said deck, means for releasing said locking means for vertical separation of a said offshore structure from said barge, a plurality of watertight hollow buoyant column stabilizers, at all times containing air as substantially the only fluid therein, located adjacent to each corner of said barge, ballast compartments below deck, means for admitting water to and for expelling it from said ballast compartments, and means for forcing air into and for expelling it from said ballast compartments, said column stabilizers being of sufficient size and water displacing area so that the resultant metacenter of the barge under full load, including the floatable offshore structure carried thereby, is always above the center of gravity under full load and also always above the center of gravity of the combined barge under full load and the ballast water needed to raise the water plane to the water plane of the floatable offshore structure, said locking means and said means for releasing enabling separation of said barge from said offshore structure by sinking said barge until said offshore structure floats and then moving said barge to one side of said offshore structure and refloating said barge.

4. A construction and launch barge, including in combination:

a barge hull of shallow draft, a construction deck supported by said hull for support of a floatable offshore structure at the center thereof during construction and during towing of said barge to an offshore site, a plurality of watertight hollow stabilizing columns, one secured adjacent each extremity of said barge and extending up high above said deck and closed off at each end so as to be quite buoyant, said columns having means for excluding water completely from their interior, a series of ballast compartments below deck, ballasting means for admitting water to and expelling air from said ballast compartment, deballasting means for forcing air into and expelling water from said ballast compartment, said stabilizing columns being of sufficient area and height and water displacing area so that the resultant metacenter of the barge under full load, including the floatable offshore structure supported thereby is always above the center of gravity under full load and also always above the center of gravity of the combined barge under full load and the ballast water needed to raise the water plane to the water plane of the floatable offshore structure, the top of said stabilizing columns being higher than the water plane of the offshore structure when it floats, some compartments lying directly below each said stabilizing columns and having said deballasting means for those said compartments in their respective columns, and control means in one single column for operating those said deballasting means simultaneously at the same flow at all times.

5. The barge of claim 4 wherein said one single column also includes means for evenly and symmetrically controlling the ballasting of said barge.

6. A construction and launch barge, including in combination:

a barge hull of shallow draft, a construction deck supported by said hull for support of a floatable offshore structure at the center thereof during construction and during towing of said barge to an offshore site, four hollow buoyant column stabilizers, cable means secured to each said column stabilizer and attached respectively to each corner of said barge, four winch means for paying out and bringing in each said column stabilizers, control means for said four winch means to assure that their operations are simultaneous and identical, a series of ballast compartments below deck, ballasting means for admitting water to and expelling it from said ballast compartment, and deballasting means for forcing air into and expelling it from said ballast compartment, said column stabilizers being of sufficient area and water displacing area and with their cables of sufficient length so that the resultant metacenter of the barge under full load, including the floatable offshore structure, is always above the center of gravity under full load and also always above the center of gravity of the combined barge under full load and the ballast water needed to raise the waterplane to the waterline of said floatable offshore structure.

* * * * *

UNITED STATES PATENT AND TRADEMARK OFFICE

CERTIFICATE OF CORRECTION

PATENT NO. : 4,015,554

DATED : April 5, 1977

INVENTOR(S) : Philip Y. Chow

It is certified that error appears in the above-identified patent and that said Letters Patent are hereby corrected as shown below:

Column 5, line 28, "$I_1V$" should read -- $\frac{I_1}{V}$--.

Signed and Sealed this second Day of August 1977

[SEAL]

*Attest:*

RUTH C. MASON
*Attesting Officer*

C. MARSHALL DANN
*Commissioner of Patents and Trademarks*